US010341789B2

(12) United States Patent
Vermeiren

(10) Patent No.: US 10,341,789 B2
(45) Date of Patent: Jul. 2, 2019

(54) IMPLANTABLE AUDITORY PROSTHESIS WITH FLOATING MASS TRANSDUCER

(71) Applicant: Cochlear Limited, Macquarie University, NSW (AU)

(72) Inventor: Jan Vermeiren, Mechelen (BE)

(73) Assignee: COCHLEAR LIMITED, Macquarie University (AU)

( * ) Notice: Subject to any disclaimer, the term of this patent is extended or adjusted under 35 U.S.C. 154(b) by 650 days.

(21) Appl. No.: 14/886,266

(22) Filed: Oct. 19, 2015

(65) Prior Publication Data

US 2016/0112812 A1 Apr. 21, 2016

Related U.S. Application Data

(60) Provisional application No. 62/065,837, filed on Oct. 20, 2014.

(51) Int. Cl.
*H04R 25/00* (2006.01)

(52) U.S. Cl.
CPC ..... *H04R 25/606* (2013.01); *H04R 2225/67* (2013.01)

(58) Field of Classification Search
CPC ..... H04R 2225/67; H04R 25/606
See application file for complete search history.

(56) References Cited

U.S. PATENT DOCUMENTS 5,800,336 A 9/1998 Ball et al.
5,897,486 A 4/1999 Ball et al.
5,913,815 A 6/1999 Ball et al.
5,997,466 A 12/1999 Adams et al.
6,005,955 A 12/1999 Kroll et al.
6,077,215 A 6/2000 Leysieffer
(Continued)

FOREIGN PATENT DOCUMENTS

WO 2004/024212 3/2004
WO 2008/121944 10/2008
WO 2011/148010 A1 12/2011

OTHER PUBLICATIONS

Eung-Pyo Hong et al., "Vibration Modeling and Design of Piezoelectric Floating Mass Transducer for Implantable Middle Ear Hearing Devices", IEICE Trans. Fundamentals, vol. E90-A, No. 8, Aug. 2007, 8 pages.

*Primary Examiner* — Christine H Matthews
(74) *Attorney, Agent, or Firm* — Edell, Shapiro & Finnan, LLC

(57) ABSTRACT

Embodiments of the present invention are generally directed to an implantable auditory prosthesis that comprises a transducer configured to be implanted in a recipient. The transducer comprises at least one bender element (e.g., piezoelectric element, magnetorestrictive element, etc.) that is configured to deform in response to application of an electrical signal thereto so as to generate vibration for delivery to the recipient. One or more components are mechanically and electrically connected to the bender element and are configured to generate additional vibration for delivery to the recipient. In certain embodiments, the one or more components mechanically coupled to the bender element comprise an inductor coil operating as a counter-mass. The inductor coil may be configured to drive another mass (e.g., a magnet) so as to operate as an active vibration generation system.

20 Claims, 6 Drawing Sheets

(56) References Cited

U.S. PATENT DOCUMENTS

| | | | | |
|---|---|---|---|---|
| 6,190,305 | B1 | 2/2001 | Ball et al. | |
| 6,517,476 | B1 | 2/2003 | Bedoya et al. | |
| 8,211,174 | B2 | 7/2012 | Park et al. | |
| 8,216,123 | B2 | 7/2012 | Cho et al. | |
| 2001/0003788 | A1* | 6/2001 | Ball | H04R 11/02 600/25 |
| 2004/0133250 | A1 | 7/2004 | Ball et al. | |
| 2005/0163333 | A1 | 7/2005 | Abel et al. | |
| 2007/0282397 | A1 | 12/2007 | Ball et al. | |
| 2008/0255406 | A1 | 10/2008 | Ball et al. | |
| 2009/0253951 | A1 | 10/2009 | Ball et al. | |
| 2010/0298626 | A1* | 11/2010 | Andersson | H04R 17/00 600/25 |
| 2012/0219166 | A1 | 8/2012 | Ball | |
| 2012/0308062 | A1 | 12/2012 | Djalilian et al. | |
| 2014/0064533 | A1 | 3/2014 | Kasic, II | |
| 2015/0382115 | A1* | 12/2015 | Meskens | H04R 25/606 381/326 |

* cited by examiner

IMPLANTABLE AUDITORY PROSTHESIS WITH FLOATING MASS TRANSDUCER

CROSS-REFERENCE TO RELATED APPLICATIONS

This application claims priority to U.S. Provisional Application No. 62/065,837 entitled "Implantable Auditory Prosthesis with Floating Mass Transducer," filed Oct. 20, 2014, the content of which is hereby incorporated by reference herein.

BACKGROUND

Field of the Invention

The present invention relates generally to implantable auditory prostheses.

Related Art

Hearing loss, which may be due to many different causes, is generally of two types, conductive and/or sensorineural. Conductive hearing loss occurs when the normal mechanical pathways of the outer and/or middle ear are impeded, for example, by damage to the ossicular chain or ear canal. Sensorineural hearing loss occurs when there is damage to the inner ear, or to the nerve pathways from the inner ear to the brain.

Individuals suffering from conductive hearing loss typically receive an acoustic hearing aid. Hearing aids rely on principles of air conduction to transmit acoustic signals to the cochlea. Typically, a hearing aid is positioned in the ear canal or on the outer ear to amplify received sound. This amplified sound is delivered to the cochlea through the normal middle ear mechanisms resulting in the increased perception of sound by the recipient.

In contrast to acoustic hearing aids, certain types of implantable auditory prostheses, sometimes referred to as implantable acoustic auditory prostheses, convert a received sound into output mechanical force (vibration) for delivery to the recipient. The vibrations are transferred through the recipient's, teeth, bone, and or other tissue to the cochlea. The vibrations cause movement of the cochlea fluid that generates nerve impulses resulting in perception of the received sound by the recipient. Acoustic auditory prostheses are suitable to treat a variety of types of hearing loss and may be prescribed for individuals who cannot derive sufficient benefit from acoustic hearing aids, cochlear implants, etc., or for individuals who suffer from stuttering problems. Implantable acoustic auditory prostheses include, for example, bone conduction devices, middle ear auditory prostheses (middle ear implants), direct acoustic stimulators (direct cochlear stimulators), or other partially or fully implantable auditory prosthesis that deliver vibrations to a recipient to directly or indirectly generate movement of the cochlea fluid.

SUMMARY

In one aspect, an implantable auditory prosthesis is provided. The implantable auditory prosthesis comprises a piezoelectric transducer configured to be implanted in a recipient and comprising at least one piezoelectric element configured to deform in response to application of electrical signals thereto so as to generate vibration for delivery to the recipient, and one or more components mechanically and electrically connected to the piezoelectric element and are configured to generate additional vibration for delivery to the recipient.

In another aspect, an implantable auditory prosthesis is provided. The implantable auditory prosthesis comprises a transducer comprising at least one bender element configured to generate vibration according to sound signals received by the device, one or more components mechanically and electrically connected to the bender element so as to generate additional vibration, and a body interface configured to deliver vibration generated by the bender element and the one or more components to a recipient.

In another aspect, a method for rehabilitating the hearing of a recipient is provided. The method comprises delivering electrical signals representative of sound to at least one piezoelectric element of a piezoelectric transducer so as to deform the piezoelectric element; generating, based on the deformation of the piezoelectric element, oscillation of one or more components mechanically and electrically coupled to the piezoelectric element; and delivering, to the recipient, vibration generated by the deformation of the piezoelectric element and the oscillation of the one or more components.

BRIEF DESCRIPTION OF THE DRAWINGS

Embodiments of the present invention are described herein in conjunction with the accompanying drawings, in which.

DETAILED DESCRIPTION

Embodiments of the present invention are generally directed to an implantable auditory prosthesis that comprises a transducer configured to be implanted in a recipient. The transducer comprises at least one bender element (e.g., piezoelectric element, magnetorestrictive element, etc.) that is configured to deform in response to application of an electrical signal thereto so as to generate vibration for delivery to the recipient. One or more components are mechanically coupled to the bender element and are configured to enhance and/or generate additional vibration for delivery to the recipient. In certain embodiments, the one or more components mechanically coupled to the bender element comprise an inductor coil operating as a counter-mass. The inductor coil may be configured to drive another mass (e.g., a magnet) so as to operate as an active vibration generation system (e.g., electromagnetic transducer).

There are different types of auditory prostheses that may be partially or fully implanted into a recipient, including implantable acoustic auditory prostheses such as bone conduction devices (e.g., percutaneous, transcutaneous, etc.), middle ear auditory prostheses, direct acoustic stimulators, etc. It is to be appreciated that embodiments presented herein may be used in connection with any of the above or other implantable auditory prostheses. However, merely for ease of description, embodiments of the present invention are primarily described herein with reference to a middle ear auditory prosthesis.

Figure 1:
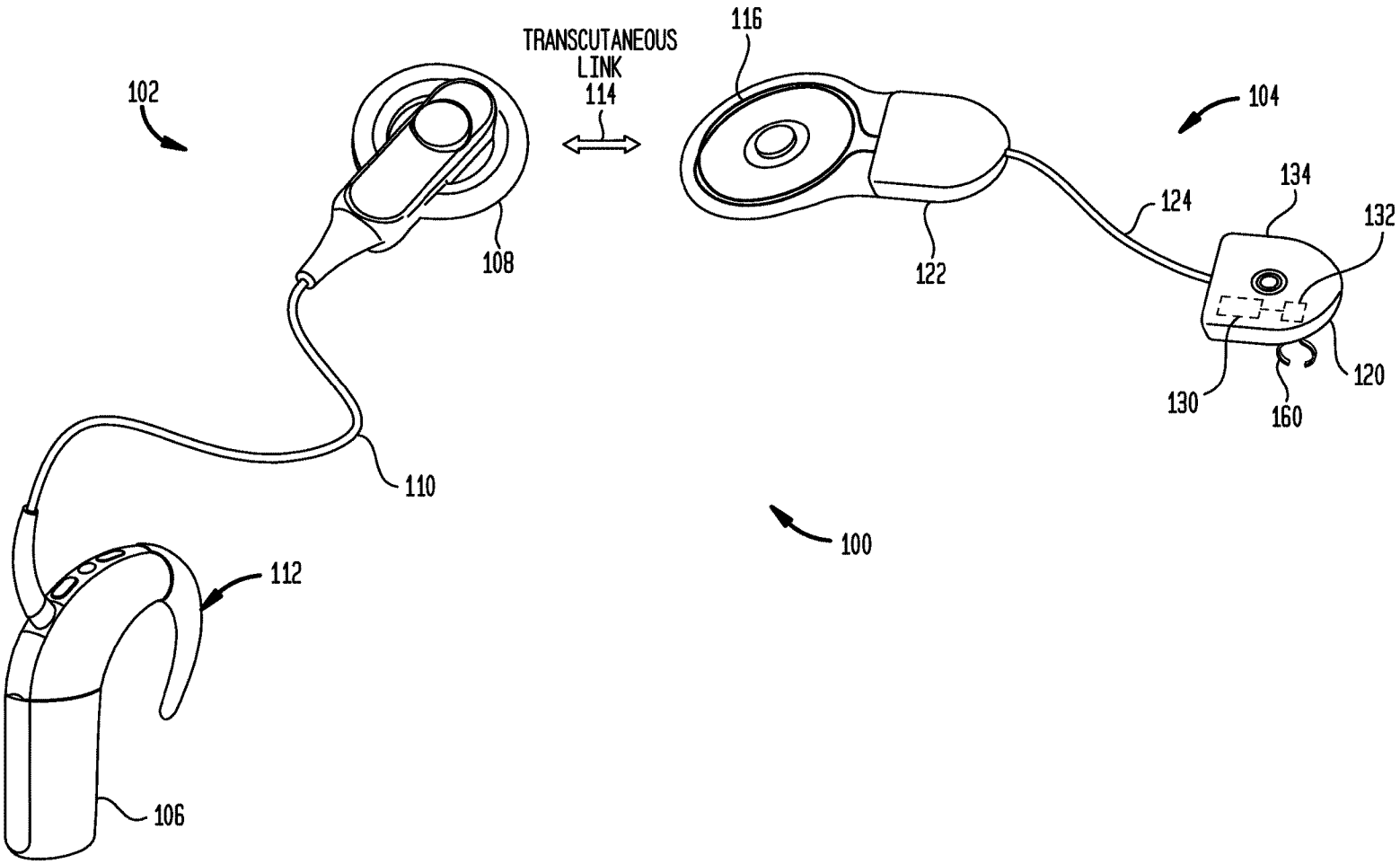
FIG. 1 is a diagram illustrating a middle ear auditory prosthesis in accordance with embodiments presented herein.

FIG. 1 is a schematic diagram illustrating a middle ear auditory prosthesis 100 in accordance with embodiments presented herein. In general, the middle ear auditory prosthesis 100 is configured to generate movement of one or more of the recipient's middle ear bones (i.e., the malleus, incus, and stapes, collectively referred to as the "ossicles") based on a received sound signal.

The middle ear auditory prosthesis 100 includes an external component 102 and an implantable component 104. The middle ear auditory prosthesis 100 of FIG. 1 is referred to as an "active" device because the implantable component 104 includes a subcutaneously implanted floating mass actuator/transducer 130. In other words, the active vibration generation component of the middle ear auditory prosthesis 100 is implanted within the recipient, rather than positioned externally. The middle ear auditory prosthesis 100 of FIG. 1 is also referred to as a "transcutaneous" device because the device includes the external component 102 that provides data for use in stimulating the hearing of a recipient.

The external component 102 is directly or indirectly attached to the body of the recipient and typically comprises an external coil 108 and, generally, a magnet (not shown in FIG. 1) fixed relative to the external coil 108. The external component 102 also comprises one or more sound input elements 112 (e.g., microphones, telecoils, etc.) for receiving sound signals, and a sound processing unit 106. The sound processing unit 106 is electrically connected to the external coil 108 via a cable or lead 110.

In the embodiment of FIG. 1, the sound processing unit 106 is a behind-the-ear sound processing unit. The sound processing unit 106 may include, for example, a power source (not shown in FIG. 1) and a sound processor (also not shown in FIG. 1). The sound processor is configured to process electrical signals generated by the sound input element 112.

As noted, FIG. 1 illustrates an example in which middle ear auditory prosthesis 100 includes an external component 102 with an external sound processor. It is to be appreciated that the use of an external component is merely illustrative and that the techniques presented herein may be used in arrangements having an implanted sound processor, an implanted microphone, and/or an implanted power source (battery). It is also to be appreciated that the individual components referenced herein, e.g., sound input elements, the sound processor, etc., may be distributed across more than one device, e.g., two middle ear auditory prostheses, and indeed across more than one type of device, e.g., a middle ear auditory prosthesis and a consumer electronic device or a remote control of the middle ear auditory prosthesis.

The implantable component 104 comprises an implantable coil 116 and, generally, a magnet (not shown) fixed relative to the internal coil 116. The magnets adjacent to the external coil 108 and the implantable coil 116 facilitate the operational alignment of the external and implantable coils. The operational alignment of the coils enables the external coil 108 to transcutaneously transmit/receive power and data to/from the implantable coil 116. More specifically, in certain examples, external coil 108 transmits electrical signals (e.g., power and data) to implantable coil 116 via a transcutaneous radio frequency (RF) link 114. External coil 108 and implantable coil 116 are typically wire antenna coils comprised of multiple turns of electrically insulated single-strand or multi-strand platinum or gold wire. The electrical insulation of implantable coil 116 is provided by a flexible silicone molding. It is to be appreciated that various other types of energy transfer, such as infrared (IR), electromagnetic, capacitive and inductive transfer, may be used to transfer the power and/or data from external component 102 to implantable component 104 and that FIG. 1 illustrates only one example arrangement.

The implantable coil 116 is electrically connected to an electronics assembly 122 that is electrically connected to a transducer assembly 120 via a lead (e.g., two-wire lead) 124. The transducer assembly 120 includes a floating mass transducer which, in the embodiments of FIG. 1, is a piezoelectric transducer 130 configured to generate mechanical output force (vibration) for delivery to the recipient's tissue (e.g., bone or other tissue).

More specifically, the electronics assembly 122 uses the data received from the external component 102 to generate electrical signals (transducer drive signals) that are delivered to a piezoelectric element (e.g., multilayer piezoelectric element) of the piezoelectric transducer 130. When delivered to the piezoelectric transducer 130, the transducer drive signals cause the piezoelectric transducer 130 to generate vibration which is transferred through a recipient's tissue and/or bone to the cochlea, thereby causing generation of nerve impulses that result in the perception of the sound signals received by the sound input element 112. The transducer assembly 120 also includes one or more components 132 mechanically coupled to the piezoelectric transducer 130. As described further below, the one or more components 132 are configured to generate additional vibration for delivery to the recipient via a body interface 160.

It is to be appreciated that the piezoelectric transducer 130 and the one or more components 132 are positioned within a housing 134 of transducer assembly 120. As such, the piezoelectric transducer 130 and the one or more components 132 are generally shown in FIG. 1 using dashed lines.

Figure 2:
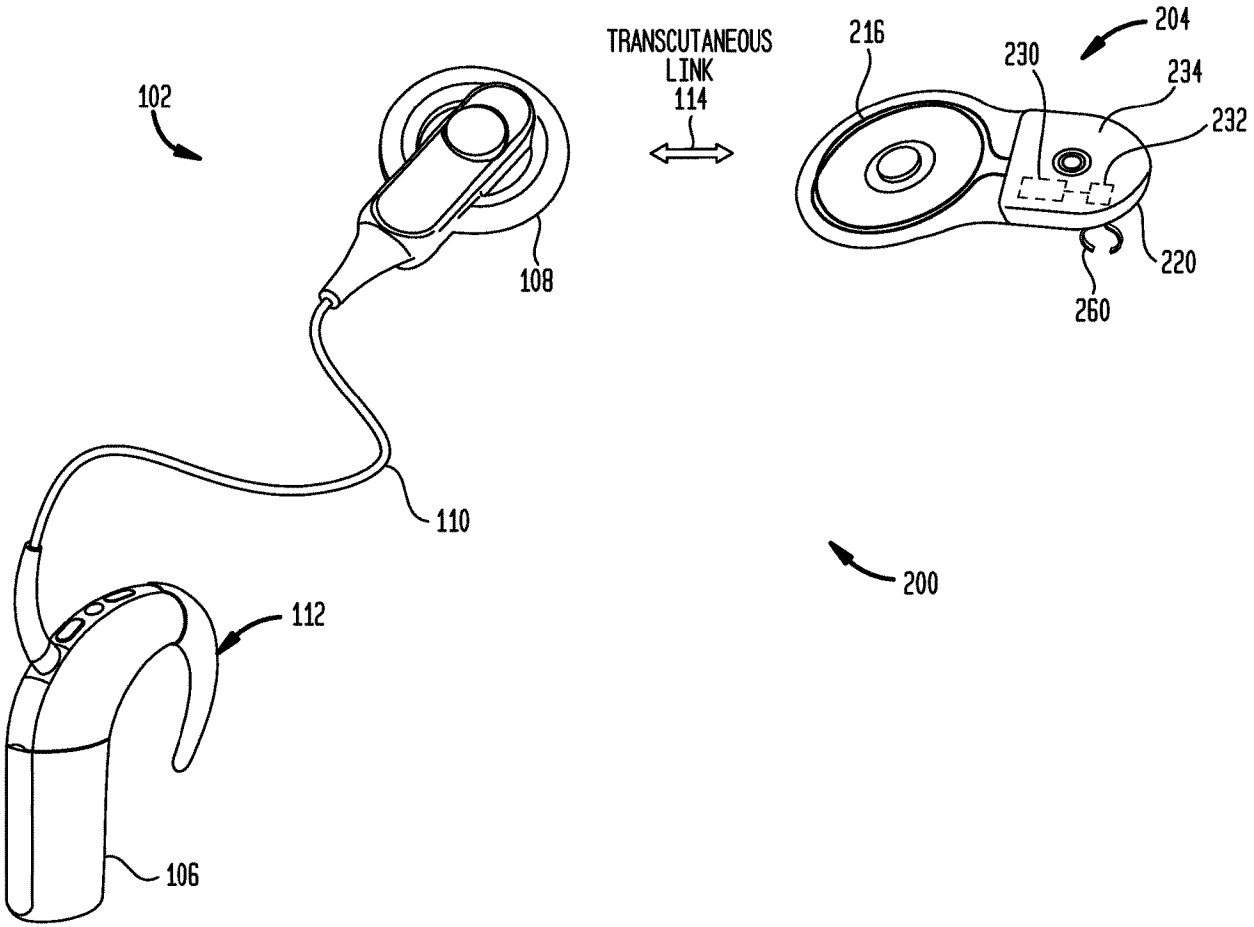
FIG. 2 is a diagram illustrating another middle ear auditory prosthesis in accordance with embodiments presented herein.

It is to be appreciated that acoustic auditory prostheses in accordance with embodiments of the present invention may have a number of different arrangements. For example, FIG. 2 illustrates a monolithic arrangement for a middle ear auditory prosthesis 200 where the external component 102 (FIG. 1) operates with an alternative implantable component 204. The implantable component 204 comprises an implantable coil 216 electrically connected to an electronics assembly (not shown in FIG. 2) that is embedded within a transducer assembly 220 (i.e., the electronics assembly and the transducer assembly 220 are disposed within the same housing). In certain embodiments, the transducer assembly 220 includes a piezoelectric transducer 230 that is configured to generate vibration for delivery to the recipient via body interface 260. Similar to the embodiment of FIG. 1, the transducer assembly 120 also includes one or more components 232 mechanically coupled to the piezoelectric transducer 230. As described further below, the one or more components 232 are configured to generate additional vibration for delivery to the recipient.

Similar to the embodiment of FIG. 1, the piezoelectric transducer 230 and the one or more components 232 are positioned within a housing 234 of transducer assembly 220. As such, the piezoelectric transducer 230 and the one or more components 232 are generally shown in FIG. 2 using dashed lines.

It is to be appreciated that the use of the external component 102, as shown in FIGS. 1 and 2, is merely illustrative and that other embodiments may use alternative external components or no external components, alternate body interfaces to contact various structures of the middle ear or inner ear, etc. For example, one alternative embodiment may use a coil sound processing unit having, for example, a generally cylindrical shape. In such an embodiment, the sound input element, sound processor, external coil, and external magnet are disposed within (or adjacent to) the same housing configured to be worn at the same location as where an external coil is traditionally located. In another embodiment, the components forming part of external component 102 (FIGS. 1 and 2) are implanted. That is, further embodiments may use an arrangement having an implanted sound processor, an implanted microphone, and/or an implanted power source (battery), etc.

Figure 3:
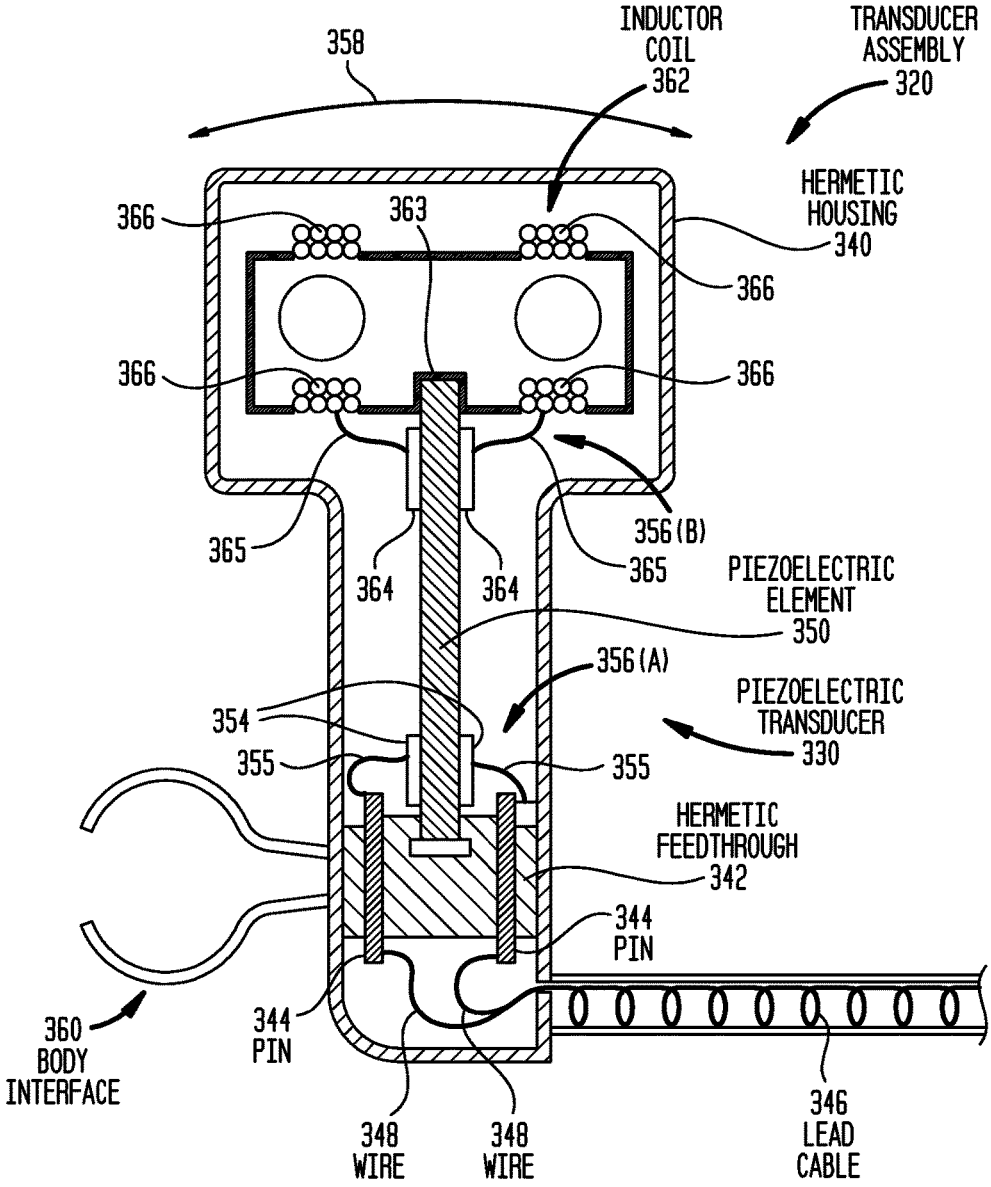
FIG. 3 is a cross-sectional schematic diagram of a transducer assembly in accordance with embodiments presented herein.

FIG. 3 is a cross-sectional schematic view of a transducer assembly 320 in accordance with embodiments of the present invention. The transducer assembly 320 comprises a hermetic housing 340 that forms a hermetically sealed enclosure for the transducer assembly 320. In certain embodiments, the hermetic housing 340 may be formed from ceramic, titanium or other biocompatible metals, etc.

In accordance with certain embodiments presented herein, the transducer assembly 320 is configured to be miniaturized relative to conventional devices so as to fit within a recipient's middle ear cavity. The hermetic housing 340 contributes to the total size of the transducer assembly 320. As such, embodiments presented herein may use a biocompatible coating/plating technique to reduce the size of the hermetic housing 340 (e.g., epoxy like coating, gold or other metal plating, etc.)

The hermetic housing 340 includes a hermetic feedthrough 342 comprising a plurality of feedthrough pins 344. The hermetic feedthrough 342 enables the transducer assembly 320 to be electrically connected to an electronics assembly (not shown in FIG. 3) via a lead cable 346. The lead cable 346 includes one or more conductors (wires) 348 that connect to the feedthrough pins 344 and extend to the electronics assembly. In certain embodiments, the lead cable 346 may have a flexible construction that can be extended, for example, as a recipient's skull grows. Such a configuration may be advantageous for implantation of devices in children.

As noted above, the use of a separate electronics assembly is merely illustrative and in alternative embodiments the components of electronics assembly may be integrated with the components of the transducer assembly 320. In certain such embodiments, the hermetic feedthrough 342 could be omitted.

Figure 4:
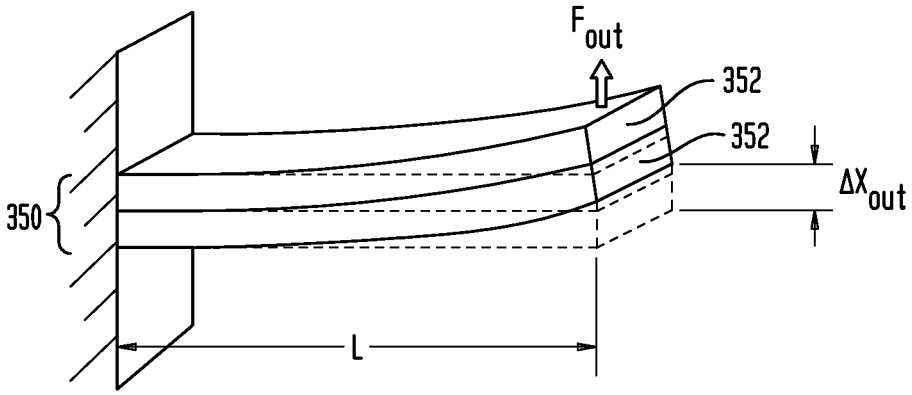
FIG. 4 is a diagram illustrating piezoelectric material forming part of a piezoelectric transducer.

The transducer assembly 320 comprises a floating mass transducer which, in the embodiments of FIG. 3, is a piezoelectric transducer 330 that includes a piezoelectric element 350. As shown in FIG. 4, the piezoelectric element 340 comprising one or more layers of piezoelectric material 342 (e.g., lead zirconium titanate (PZT), barium titanate (BaTiO30), zirconium (Zr), quartz (SiO2), Berlinite (AlPO4), Gallium orthophosphate (GaPO4), Tourmaline, etc.). The pieces of piezoelectric material 342 are capacitive elements that are configured to convert electrical signals applied thereto into a mechanical deformation (i.e. expansion or contraction) of the material. That is, by applying a voltage over the piezoelectric material 342, the piezoelectric material deforms (i.e., the mechanical position state of the piezoelectric material will change from an initial state) to generate an output force ($F_{out}$). As such, the electrical energy applied to the piezoelectric material 342 is, at least in part, transferred into mechanical energy.

The amount of deformation ($\Delta X_{out}$) of the piezoelectric material 342 in response to an applied electrical signal may depend on, for example, the inherent properties of the material, orientation of the electric field with respect to the polarization direction of the piezoelectric material, geometry of the piezoelectric material, etc. Reinforced mechanical motion may be produced by grouping identical layers of electrodes interleaved with piezoelectric material. In particular, the segments may be interconnected mechanically in series (sum of mechanical forces) and connected electrically in parallel so as to produce the mechanical motion.

Returning to FIG. 3, transducer drive signals (electrical signals) are applied to the piezoelectric element 350 via one of the conductive pads 354 attached to a first end 356(A) of the piezoelectric element 350. The conductive pads 354, which are electrically connected to the feedthrough pins 344 via wire conductors 355, receive the electrical signals via the wires 348 of lead cable 346. The electrical signals may be alternating current (AC) signals that, when applied to the piezoelectric element 350, cause a second end 356(B) of the piezoelectric element 350 to oscillate in the directions shown by bi-directional arrow 358. With AC signals, the direction current periodically reverses/alternates and a first direction of the current flow may cause the piezoelectric element 350 to deform in a first direction, while the second direction of the current flow may cause the piezoelectric element 350 to deform in a second direction that is opposite to the first direction, thereby creating the oscillation of second end 356(B) of the piezoelectric element 350.

The piezoelectric element is mechanically coupled to the hermetic housing 340 which is substantially rigidly attached to the recipient via an interface 360 with the recipient's body. As such, the oscillation of second end 356(B) generates vibration that is delivered to the recipient via body interface 360. Body interface 360 may take a number of different forms for attachment to various anatomical structures of the middle ear or inner ear (e.g., ossicles in the middle ear, round window, oval window, etc.). In the example of FIG. 3, the body interface 360 is a clip mechanism for attachment to the recipient's middle ear bones (e.g., the recipient's incus). As such, in this specific example, oscillation of the piezoelectric element 350 generates movement of the recipient's middle ear bones.

It is to be appreciated that the body interface 360 shown in FIG. 3 is merely illustrative and that other body interfaces may be used in alternative arrangements. For example in one alternative embodiment the body interface 360 may comprise a coupling and bone screw. In still other embodiments, the body interface may comprise a region of the hermetic housing 340 attached to the recipient using bone cement or another fixation mechanism.

As noted, the oscillation of the piezoelectric element 350 generates vibration that is delivered to the recipient. In the embodiment of FIG. 3, one or more components are included in the transducer assembly 320 to increase the vibration that is delivered to the recipient. More specifically, in the embodiment of FIG. 3 a component in the form of an inductor coil 362 is mechanically coupled to the second end 356(B) of the piezoelectric element 350. Due to the mechanical connection with piezoelectric element 350, the inductor coil 362 will move in response to the oscillation of the piezoelectric element 350. That is, when second end 356(B) of the piezoelectric element 350 oscillates in the direction of arrow 358, the inductor coil 362 will also oscillate in the direction shown by arrow 358. As such, the inductor coil 362, which is mechanically coupled to the piezoelectric element 350, is configured to generate additional vibration for delivery to the recipient (i.e., generate additional vibration in response to oscillation of the piezoelectric element 350).

In general, the inductor coil 362 comprises a plurality of wire loops 366 that collectively have a large mass relative to that of piezoelectric element 350. As such, the additional mechanical force generated by the inductor coil 362 may be greater than the mechanical force generated by oscillation of the piezoelectric element 350 alone. In essence, the inductor coil 362 operates as a counter-mass component to increase the vibration generated by the transducer assembly 320.

The inductor coil 362 may be mechanically connected to the second end 356(B) of piezoelectric element 350 in a number of different manners. In the specific arrangement of FIG. 3, a support bracket 363 is attached to the second end 356(B) and to a plurality of the wire loops 366.

In addition to the mechanical connection, the inductor coil 362 is also electrically connected to the piezoelectric element 350. Conductive pads 364 are attached near the second end 356(B) of the piezoelectric element 350 and are electrically connected to opposing ends of the inductor coil 362 (i.e., the wire loops 366 disposed at the opposing ends of the inductor coil). This electrical connection between the piezoelectric element 350 and the inductor coil 362 enables the inductor coil 362 to operate as an energy recovery element that is configured to extract non-used energy from the piezoelectric element 350 and to store the non-used energy for subsequent use by the piezoelectric element.

More specifically, the piezoelectric element 350 is a capacitive load that builds up or releases electrical charge following the raising or descending slope of incoming drive signals. In operation, the electrical connection between the inductor coil 362 and the piezoelectric element 350 enables the inductor coil 362 to extract and store energy that is not used by the piezoelectric element 350 to effect deformation of the second end 356(B). The extracted and stored energy may then be added back to the piezoelectric element 350 to effect further deformation (e.g., deformation in an opposite direction). As such, the inductor coil 362 is sometimes referred to herein as energy recovery inductor 362.

In summary, FIG. 3 illustrates an arrangement in which at least one inductor coil 362 is mechanically and electrically connected to the piezoelectric element 350. The inductor coil 362 forms part of a continuous electrical circuit with the piezoelectric element 350 and is a dual-function component (i.e., a component that operates to increase the vibration generated by the transducer assembly 320 and to perform charge recovery).

Figure 5:
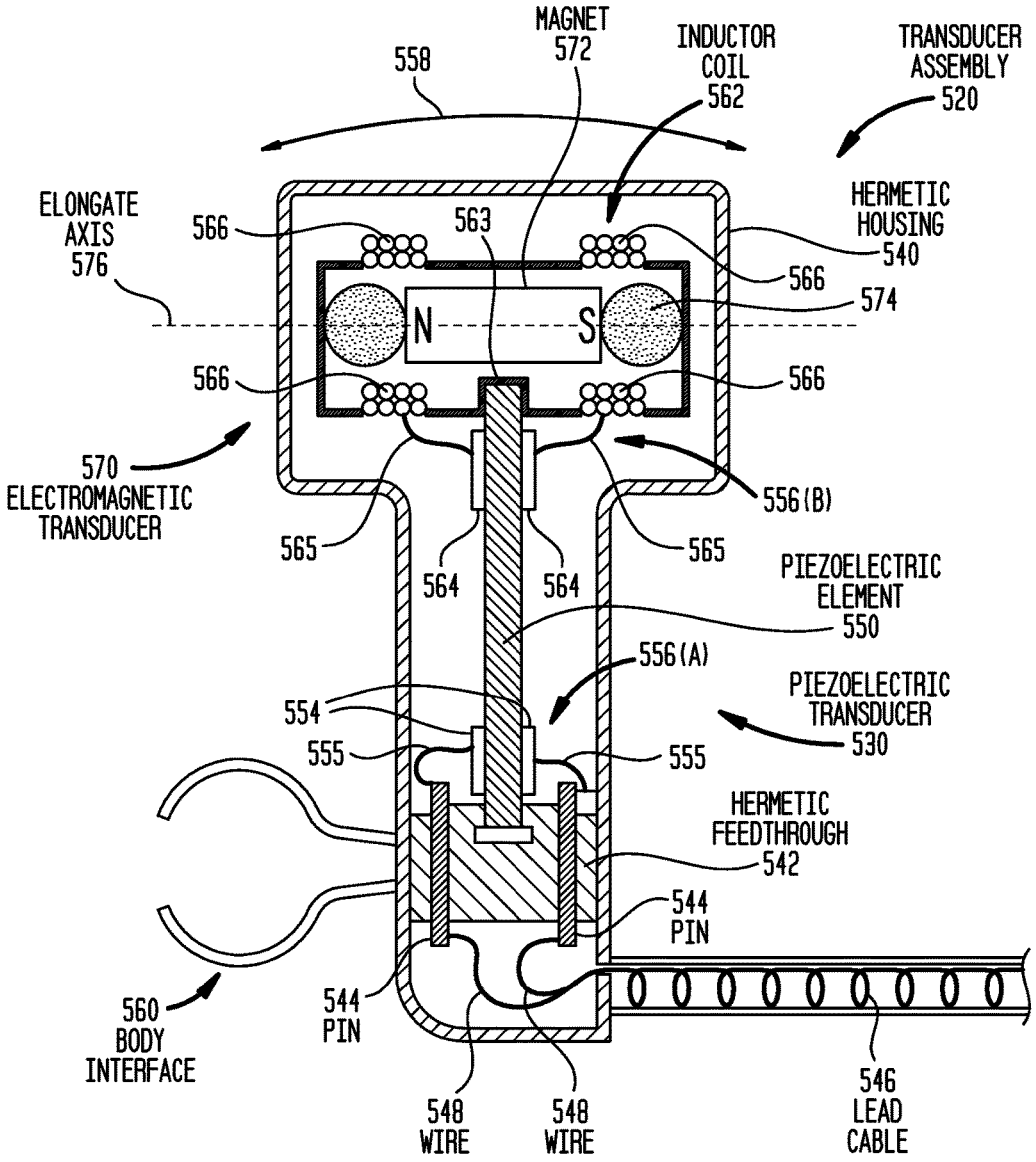
FIG. 5 is a cross-sectional schematic diagram of another transducer assembly in accordance with embodiments presented herein.

FIG. 3 illustrates an example where the mechanical coupling between a piezoelectric element and one or more components contributes to the generation of additional vibration by the one or more components. FIG. 5 illustrates a further embodiment in which both the mechanical and the electrical connections between a piezoelectric element and one or more components contribute to the generation of additional output force by the one or more components. More specifically, FIG. 5 is a cross-sectional schematic view of a transducer assembly 520 in accordance with embodiments of the present invention. The transducer assembly 520 comprises a hermetic housing 540 that forms a hermetically sealed enclosure for the transducer assembly 520. Similar to the example of FIG. 3, the hermetic housing 540 may be formed from ceramic, titanium or other biocompatible metals, a biocompatible coating/plating, etc.

The hermetic housing 540 includes a hermetic feedthrough 542 that comprises a plurality of feedthrough pins 544. The hermetic feedthrough 542 enables the transducer assembly 520 to be electrically connected to an electronics assembly (not shown in FIG. 3) via a flexible lead cable 546 that may be similar to lead cable 346 of FIG. 3. The lead cable 546 includes one or more conductors (wires) 548 that connect to the feedthrough pins 544 and extend to the electronics assembly. As noted above, the use of a separate electronics assembly is merely illustrative and in alternative embodiments the components of electronics assembly may be integrated with the components of the transducer assembly 520. In certain such embodiments, the hermetic feedthrough 542 could be omitted.

The transducer assembly 520 comprises a floating mass transducer which, in the embodiments of FIG. 5, is a piezoelectric transducer 530 that includes a piezoelectric element 350 that is substantially similar to piezoelectric element 350 of FIG. 3. That is, the piezoelectric element 550 is formed from one or more layers of capacitive material that are configured to convert applied electrical signals into mechanical deformation (i.e. expansion or contraction) of the material. As such, electrical energy applied to the piezoelectric element 550 is, at least in part, transferred into mechanical energy.

Electrical signals (transducer drive signals) are applied to the piezoelectric element 550 via one of the conductive pads 554 attached to a first end 556(A) of the piezoelectric element 550. The conductive pads 554, which are electrically connected to the feedthrough pins 544 via wire conductors 555, receive the electrical signals via the wires 548 of lead cable 546. The electrical signals may be AC signals that, when applied to the piezoelectric element 550, cause a second end 556(B) of the piezoelectric element 550 to oscillate in the directions shown by bi-directional arrow 558. As noted above, since the direction of current periodically reverses/alternates in AC signals, a first direction of the current flow may cause the piezoelectric element 550 to deform in a first direction, while the second direction of the current flow may cause the piezoelectric element 550 to deform in a second direction that is opposite to the first direction, thereby creating the oscillation of second end 556(B) of the piezoelectric element 550. The oscillation of second end 556(B) generates vibration that is delivered to the recipient via an interface 560 with the recipient's body.

Body interface 560 may take a number of different forms for attachment to various anatomical structures of the middle ear or inner ear (e.g., ossicles in the middle ear, round window, oval window, etc.). In the example of FIG. 5, the body interface 560 is a clip mechanism for attachment to the recipient's middle ear bones (e.g., the recipient's incus). As such, in this specific example, oscillation of the piezoelectric element 550 generates movement of the recipient's middle ear bones.

As noted, the oscillation of the piezoelectric element 550 generates vibration for delivery to the recipient. In the embodiment of FIG. 5, one or more components are included in transducer assembly 520 to increase the vibration delivered to the recipient. More specifically, in the embodiment of FIG. 5 a plurality of components forming an electromagnetic (EM) transducer 570 are mechanically coupled to the second end 556(B) of the piezoelectric element 550. In other words, in the arrangement of FIG. 5, an electromagnetic transducer 570 is mechanically coupled to the piezoelectric transducer 530

The electromagnetic transducer 570 comprises a magnet 572, an inductor coil 562 comprising a plurality of wire loops 566, and isolation members 574. The magnet 572 is an elongate magnet having an elongate axis 576 extending there through. The wire loops 566 of inductor coil 562 are disposed at and/or around the ends of the magnet 572 generally perpendicular to elongate axis 576. A support bracket 563 is provided that attaches to the second end 556(B) of the piezoelectric element 550 and to a plurality of the wire loops 566. In one specific embodiment, the support bracket 563 forms a sub-housing in which the magnet 572 is positioned. The isolation members 574 may be formed from a resiliently flexible material (e.g., rubber, silicone, etc.) that mechanically isolates the magnet 572 from the support bracket 563.

It is to be appreciated that the electromagnetic transducer 570 may be mechanically connected to the second end 556(B) of piezoelectric element 550 in a number of different manners. As such, the use of the support bracket 563 in FIG. 5 is merely illustrative of an example mechanical connection.

Due to the mechanical connection with piezoelectric element 550, the electromagnetic transducer 570 will move in response to the oscillation of the piezoelectric element 550. That is, when second end 556(B) of the piezoelectric element 550 oscillates in the direction of arrow 558, the electromagnetic transducer 570 will also oscillate in the direction shown by arrow 558. As such, the electromagnetic transducer 570, which is mechanically coupled to the piezoelectric element 550, is configured to generate additional vibration for delivery to the recipient (i.e., generate additional vibration in response to oscillation of the piezoelectric element 550).

In general, the wire loops 566, magnet 572, isolation members 574, and support bracket 563 collectively have a mass that is large relative to that of the piezoelectric element 550. As such, the additional mechanical force generated by the electromagnetic transducer 570 may be greater than the vibration generated by oscillation of the piezoelectric element 550 alone. In essence, the electromagnetic transducer 570 may operate as a counter-mass component to increase the vibration generated by the transducer assembly 520.

As noted above, in addition to the mechanical connection, the electromagnetic transducer 570 is also electrically connected to the piezoelectric element 550. Conductive pads 564, which are attached near the second end 556(B) of the piezoelectric element 550, are electrically connected to opposing ends of the inductor coil 562 (i.e., the wire loops 566 disposed at the opposing ends of the inductor coil). This electrical connection between the piezoelectric element 550 and the inductor coil 562 enables the electromagnetic transducer 570 to be driven through the piezoelectric element 550. That is, the electromagnetic transducer 570 is configured to be activated by the same signals delivered to the piezoelectric element 550.

As noted above, in the arrangement of FIG. 5 current is delivered to the piezoelectric element 550. A portion of the current is consumed at the piezoelectric element 550 to generate deformation of the piezoelectric element. However, at least some of the current passes through the piezoelectric element 550 to the inductor coil 562 via pads 564 at second end 556(B). The current flows through the inductor coil 562 so as to cause the electromagnetic vibrator 570 to generate oscillation in the direction of arrow 588 that is separate from the oscillation generated by piezoelectric element 550. More specifically, as the current flows through the inductor coil 562, the magnet 572 will reciprocate generally along elongate axis 576. The reciprocating movement of magnet 572 generates independent and supplementary vibration that may be delivered to the recipient through body interface 560.

In such embodiments, the piezoelectric transducer 550 generates vibration (i.e., through oscillation of the piezoelectric element 550) for delivery to the recipient and the electromagnetic transducer 570 generates vibration (i.e., through the reciprocating movement of magnet 572) for delivery to the recipient. The vibration generated by the piezoelectric transducer 550 and the vibration generated by the electromagnetic transducer 570 are generally complementary/cooperative. As such, FIG. 5 illustrates an embodiment in which two transducers operating according to different activation principles (e.g., the piezoelectric effect and the electromagnetic affect) are mechanically and electrically coupled in a manner that enables the transducers to cooperate to generate vibration for delivery to a recipient.

In certain embodiments, the piezoelectric transducer 550 and the electromagnetic transducer 570 have different resonant frequencies. In such embodiments, the combined vibration of the piezoelectric transducer 550 and the electromagnetic transducer 570 creates an efficient system with a broader frequency range than devices that use only a piezoelectric transducer or an electromagnetic transducer 570. For example, in one such embodiment the system may have a response characteristic with multiple maxima.

The electrical connection between the piezoelectric element 550 and the inductor coil 562 may also enable the inductor coil 562 to operate as an energy recovery element. More specifically, similar to the embodiment of FIG. 3, the inductor coil 562 may be configured to extract and store energy that is not used by the piezoelectric element 550 to effect deformation of the second end 556(B). The extracted and stored energy may then be added back to the piezoelectric element 550 to effect further deformation (e.g., deformation in an opposite direction). As such, the inductor coil 562 is sometimes referred to herein as energy recovery inductor 562.

In summary, FIG. 5 illustrates an arrangement in which the electromagnetic transducer 570 is mechanically and electrically connected to a piezoelectric transducer 530. The electromagnetic transducer 570 forms part of a continuous electrical circuit with the piezoelectric transducer 570 and is a multi-function component that can create additional vibration in multiple manners. In particular, the electromagnetic transducer 570 generates additional vibration as a result of the mechanical coupling to piezoelectric transducer 530 by operating as counter-mass component for the piezoelectric element 550. Additionally, the electromagnetic transducer 570 operates as an active vibration generation system to generate supplementary vibration based on electrical signals received through the piezoelectric element 550. Finally, the inductor coil 562 of the electromagnetic transducer 570 may operate as an energy recovery element that is configured to extract non-used energy from the piezoelectric element 550 and to store the non-used energy for subsequent use by the piezoelectric element.

Figure 6:
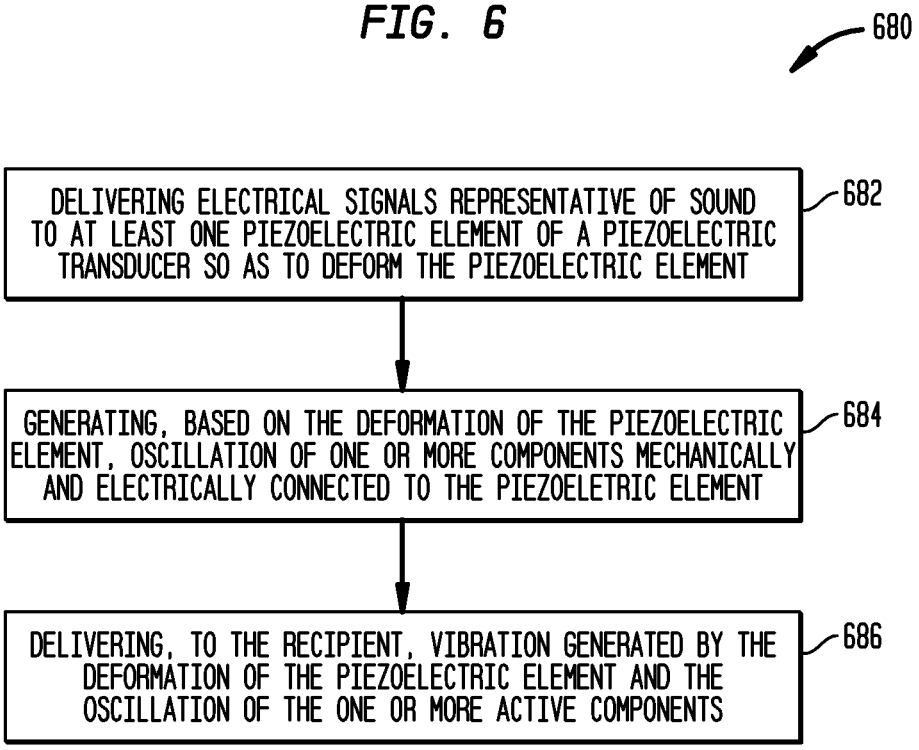
FIG. 6 is a flowchart of a method in accordance with embodiments presented herein.

FIG. 6 is a flowchart of a method 680 in accordance with embodiments of the present invention. Method 680 begins at 682 where electrical signals representative of sound are delivered to at least one piezoelectric element of a piezoelectric transducer so as to deform the piezoelectric element. At 684, based on the deformation of the piezoelectric element, oscillation of one or more components mechanically coupled to the piezoelectric element is generated. At 686, vibration generated by the deformation of the piezoelectric element and the oscillation of the one or more components is delivered to the recipient.

As noted above, embodiments presented herein are directed to use of one or more components as a counter-mass for a bender element, such as a piezoelectric element of a piezoelectric transducer. In general, an inductor coil is used as the counter-mass and the counter-mass may, in certain embodiments, drive another mass (e.g., a magnet). Such a system may have a small volume with increased mechanical and electrical efficiency. The combination of the piezoelectric transducer with an electromagnetic transducer, as described above, may utilize a single point of attachment The invention described and claimed herein is not to be limited in scope by the specific preferred embodiments herein disclosed, since these embodiments are intended as illustrations, and not limitations, of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. An implantable auditory prosthesis, comprising:

a piezoelectric transducer configured to be implanted in a recipient and comprising at least one piezoelectric element configured to deform in response to application of electrical signals thereto so as to generate vibration for delivery to the recipient; and one or more charge recovery inductors mechanically and electrically connected to the at least one piezoelectric element, wherein the one or more charge recovery inductors are configured to generate additional vibration for delivery to the recipient and are configured to extract non-used energy from the at least one piezoelectric element and to store the non-used energy for subsequent use by the at least one piezoelectric element.

2. The implantable auditory prosthesis of claim 1, wherein the one or more charge recovery inductors are mechanically coupled to the at least one piezoelectric element so as to operate as a counter-mass to increase the vibration generated in response to deformation of the at least one piezoelectric element.

3. The implantable auditory prosthesis of claim 1, wherein the implantable auditory prosthesis is a bone conduction device.

4. The implantable auditory prosthesis of claim 1, wherein the implantable auditory prosthesis is a middle ear auditory prosthesis.

5. The implantable auditory prosthesis of claim 1, further comprising:

a sound input element configured to receive one or more sound signals; and an electronics module configured to generate the electrical signals based on the one or more sound signals so as to cause the piezoelectric transducer and the one or more charge recovery inductors to generate vibration resulting in perception by the recipient of the one or more sound signals.

6. The implantable auditory prosthesis of claim 5, wherein at least one of the sound input element and the electronics module are implantable in the recipient.

7. The implantable auditory prosthesis of claim 1, further comprising:

a body interface configured to deliver the vibration generated by the piezoelectric transducer and the one or more charge recovery inductors to the recipient.

8. The implantable auditory prosthesis of claim 7, wherein the body interface is a clip mechanism for attachment to one or more middle ear bones of the recipient.

9. An implantable auditory prosthesis comprising:

a transducer comprising at least one bender element configured to generate vibration according to sound signals received by the implantable auditory prosthesis;

an electromagnetic transducer mechanically and electrically connected to the at least one bender element so as to generate additional vibration using electrical signals received via the at least one bender element; and a body interface configured to deliver vibration generated by the at least one bender element and the electromagnetic transducer to a recipient.

10. The implantable auditory prosthesis of claim 9, wherein the electromagnetic transducer is mechanically coupled to the at least one bender element so as to operate as a counter-mass to increase the vibration generated in response to deformation of the at least one bender element.

11. The implantable auditory prosthesis of claim 9, wherein the implantable auditory prosthesis is a bone conduction device.

12. The implantable auditory prosthesis of claim 9, wherein the implantable auditory prosthesis is a middle ear auditory prosthesis.

13. The implantable auditory prosthesis of claim 12, further comprising:

a sound input element configured to receive the sound signals; and an electronics module configured to generate the electrical signals based on the one or more sound signals so as to cause the piezoelectric transducer and the electromagnetic transducer to generate vibration resulting in perception by the recipient of the one or more sound signals.

14. The implantable auditory prosthesis of claim 9, wherein the at least one bender element and the electromagnetic transducer have different resonant frequencies.

15. The implantable auditory prosthesis of claim 9, wherein the at least one bender element is a piezoelectric element.

16. The implantable auditory prosthesis of claim 9, wherein the at least one bender element is a magnetostrictive element.

17. A method for rehabilitating the hearing of a recipient, comprising:

delivering electrical signals representative of sound to at least one piezoelectric element of a piezoelectric transducer so as to deform the at least one piezoelectric element;

generating, based on the deformation of the at least one piezoelectric element, oscillation of at least one inductor coil mechanically and electrically coupled to the at least one piezoelectric element;

delivering, to the recipient, vibration generated by the deformation of the at least one piezoelectric element and the oscillation of the one at least one inductor coil;

extracting non-used energy from the at least one piezoelectric element;

storing the non-used energy for subsequent use by the at least one piezoelectric element; and providing the stored non-used energy to the at least one piezoelectric element.

18. The method of claim 17, further comprising:

receiving the sound via a sound input element implantable in the recipient.

19. A method for rehabilitating the hearing of a recipient, comprising:

delivering electrical signals representative of sound to at least one piezoelectric element of a piezoelectric transducer so as to deform the at least one piezoelectric element;

generating, based on the deformation of the at least one piezoelectric element, oscillation of one or more components mechanically and electrically coupled to the at least one piezoelectric element, wherein the one or more components comprise a magnet around which one or more inductor coils are positioned;

delivering, to the recipient, vibration generated by the deformation of the at least one piezoelectric element and the oscillation of the one or more components;

delivering the electrical signals representative of sound to the one or more inductor coils via the at least one piezoelectric element so as to generate motion of the magnet, wherein the motion of the magnet generates supplementary vibration; and delivering the supplementary vibration to the recipient with the vibration generated by the deformation of the at least one piezoelectric element and the oscillation of the one or more components.

20. The method of claim 19, further comprising:

receiving the sound via a sound input element implantable in the recipient.

* * * * *